US006722172B2

(12) United States Patent
Pinkhasov et al.

(10) Patent No.: US 6,722,172 B2
(45) Date of Patent: Apr. 20, 2004

(54) METHOD AND APPARATUS FOR DECODING LOCKS

(76) Inventors: Albert Pinkhasov, 4722 Wistar Rd., Richmond, VA (US) 23228; Pinkhas Pinkhasov, 4722 Wistar Rd., Richmond, VA (US) 23228

( * ) Notice: Subject to any disclaimer, the term of this patent is extended or adjusted under 35 U.S.C. 154(b) by 0 days.

(21) Appl. No.: 10/369,659

(22) Filed: Feb. 21, 2003

(65) Prior Publication Data

US 2003/0159480 A1 Aug. 28, 2003

Related U.S. Application Data

(60) Provisional application No. 60/359,571, filed on Feb. 26, 2002.

(51) Int. Cl.[7] ..... E05B 19/20

(52) U.S. Cl. ..... 70/394; 70/278.3; 33/540; 340/5.65

(58) Field of Search ..... 70/394, 277, 278.2, 70/278.3; 33/539, 540; 340/5.6, 5.65, 5.67

(56) References Cited

U.S. PATENT DOCUMENTS

| | | | | | |
|---|---|---|---|---|---|
| 1,695,518 | A | | 12/1928 | Watson | 70/277 |
| 1,728,310 | A | | 9/1929 | Sundel | 70/428 |
| 3,225,576 | A | | 12/1965 | Richard | 70/434 |
| 3,264,742 | A | | 8/1966 | Roland | |
| 3,347,072 | A | * | 10/1967 | Rose | 70/277 |
| 4,192,400 | A | * | 3/1980 | McEwan | 180/287 |
| 4,229,959 | A | | 10/1980 | Easley | 70/394 |
| 4,535,546 | A | * | 8/1985 | Smith | 33/540 |
| 5,133,202 | A | | 7/1992 | Grant | 70/394 X |
| 5,172,578 | A | * | 12/1992 | Bitzios | 70/394 |
| 5,224,365 | A | * | 7/1993 | Dobbs | 70/394 |
| 5,289,177 | A | * | 2/1994 | Wake | 307/10.2 X |
| 5,325,691 | A | * | 7/1994 | Embry | 70/394 |
| 6,382,007 | B1 | | 5/2002 | Wright | 70/394 |

FOREIGN PATENT DOCUMENTS

| | | | | |
|---|---|---|---|---|
| EP | 0339102 | * | 11/1989 | 70/277 |
| FR | 2500520 | * | 8/1982 | 70/409 |
| SU | 1008397 | * | 3/1983 | 70/278.2 |
| SU | 1461847 | * | 2/1989 | 70/278.2 |

* cited by examiner

*Primary Examiner*—Lloyd A. Gall
(74) *Attorney, Agent, or Firm*—Norman Rainer

(57) ABSTRACT

An apparatus for decoding locks having a series of parallel spring-urged slideable members includes a probe device having the general contour of a key expected to fit the lock. The probe device has a shank portion having straight upper and lower edges. A series of thin force sensors supplied with electrical current is attached to at least the upper edge of the shank in a spaced apart relationship corresponding to the spacing of the slideable members. When the probe device is inserted into the lock, the spring associated with each slideable member exerts a force upon the corresponding sensor which is proportionate to the requisite travel distance of the slideable member. Such force is converted by the sensor to an appropriate electrical output which is routed to an electronic monitor that displays the ascertained travel distance for each slideable member.

11 Claims, 2 Drawing Sheets

METHOD AND APPARATUS FOR DECODING LOCKS

This application claims the benefit of provisional application No. 60/359,571, filed Feb. 26, 2002.

BACKGROUND OF THE INVENTION

1. Field of the Invention

This invention relates to the making of keys for tumbler and wafer type locks, and more particularly concerns a system for determining how to make a key to replace a lost key for a specific tumbler or wafer lock.

2. Description of the Prior Art

In cylinder locks of conventional design, a cylindrical plug having a key receiving slot or "keyway" bounded by straight upper and lower border surfaces, and having a first series of radially disposed channels communicating with said upper border surface is rotatably secured within a close fitting cylindrical bore in a housing having a second, matching series of channels, known as "pin chambers." The pin chambers are in coaxial alignment with the first series of channels, and open upon said bore. The opposite extremities of the pin chambers, furthest from the bore, are closed. Each pin chamber confines a coil spring in abutment with said closed extremity, a driver pin and a tumbler pin. In some locks the several paired driver pins and tumbler pins are matched to have equal total lengths, and some locks have equal length driver pins with varying length tumbler pins. Both the driver pin and tumbler pin of each chamber are downwardly urged by said spring in a direction transverse to the axis of the plug, whereby the tumbler pins span the gap between the plug and housing.

The lengths of the tumbler pins, and their axial location determine the "code" or key cut depths. When a properly configured key is inserted into the keyway of the plug, the tumbler pins are pushed up to a location flush with the outer surface of the plug, said location called a "shear line." When all the tumbler pins are flush with the surface of the plug, the shear line is "open," and rotation of the plug is permitted. The extent of pushed displacement of the tumbler pins to achieve an open shear line may be referred to as the "travel distance" for a given tumbler pin. The pushing action is achieved by the key acting upon the lowermost extremity of the tumbler pin, which serves as a bearing surface. If a tumbler pin crosses the shear line, the plug will not rotate.

Wafer locks, like tumbler locks, have a cylindrical key receiving plug rotatably secured within a close fitting bore in a housing. The plug holds a series of flat apertured wafers adapted to undergo sliding movement in planes transverse to the axis of elongation of the plug. An outermost edge of each wafer is adapted to enter an aligned locking groove within the bore, and the wafers are spring urged to cause such entrance into the grooves, thereby preventing rotation of the bore in the locked state of the lock.

The aperture of each wafer has an upper edge bearing surface whose distance of separation from said axis varies amongst the several wafers. A key inserted into the plug sequentially penetrates the apertures of the wafers while bearing against said upper edges. Such action causes sliding movement of the wafers against the urging of said spring interactive with each wafer. The sequential sliding movement of the wafers causes the outermost extremities of the wafers to align themselves with the surface of the plug, thereby establishing a shear line which permits rotation of the plug. The axial location of each wafer, and the radial location of the upper edge of the aperture determine the key code for a particular lock.

When a key for a specific lock is lost, it often becomes necessary to analyze the lock to ascertain the requisite code for producing a replacement key. Probe devices for determining the key cuts of locks have earlier been disclosed, as for example in U.S. Pat. Nos. 4,535,546; 4,680,870; 5,224,365; 5,325,691; and 5,172,578. Such earlier devices are based upon mechanical principles of operation, and are often limited to use on certain models of locks, unless significant change is made in the probe device. U.S. Pat. Nos. 5,133,202 and 6,382,007 disclose lock decoding systems involving key-shaped probes having contact points that achieve completion of an electrical circuit at each tumbler, and monitoring means responsive to the resultant electrical current to indicate the travel distance and axial location of each tumbler. Said earlier probe devices are usually difficult to operate, or require time-consuming manipulations, and are often of considerable cost.

It is accordingly an object of the present invention to provide a system for decoding tumbler and wafer locks.

It is another object of this invention to provide a system as in the foregoing object for ascertaining key cuts, and having versatility of use in many different models of locks.

It is a further object of the present invention to provide a system of the aforesaid nature for easily and rapidly ascertaining key cuts for locks.

It is a still further object of this invention to provide a decoding system of the aforesaid nature of durable and simple construction amenable to low cost manufacture.

These objects and other objects and advantages of the invention will be apparent from the following description.

SUMMARY OF THE INVENTION

The above and other beneficial objects and advantages are accomplished in accordance with the present invention by apparatus for decoding tumbler and wafer locks having a rotatably mounted cylindrical plug having an elongated key receiving slot interactive with a series of slideable members urged by identical coil springs orthogonally toward said slot and having different travel distances relative to flush fit with the cylindrical surface of said plug, said flush fit establishing a shear line which permits rotation of the plug, said springs undergoing linear compression by said key by an amount equal to said travel distance, and producing a resistive force proportionate to said travel distance, said apparatus comprising:

a) a probe device having the general contour of a key expected to fit within said key-receiving slot and having:
   1) a straight shank elongated between forward and rearward extremities and bounded by opposed side surfaces and upper and lower edge surfaces, and terminating in a tip portion having an oblique ramp surface extending forwardly and downwardly from said upper edge surface,
   2) a series of spaced apart force sensors associated with said upper edge surface, said sensors being capable of changing their electrical resistance in response to force applied thereto,
   3) a head portion associated with the rearward extremity of said shank to facilitate manipulation of the probe device, and equipped with electrical terminals, and
   4) electrical conductor means extending from each sensor to said electrical terminals, b) electronic monitoring and display means interactive with said sensors by way of said terminals and serving to indicate the combined force attributed to the effect of said spring and the weight of said slideable members for each slideable member of said series, and c) a source of low voltage direct current adapted to flow through said sensors and electronic monitoring and display means.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
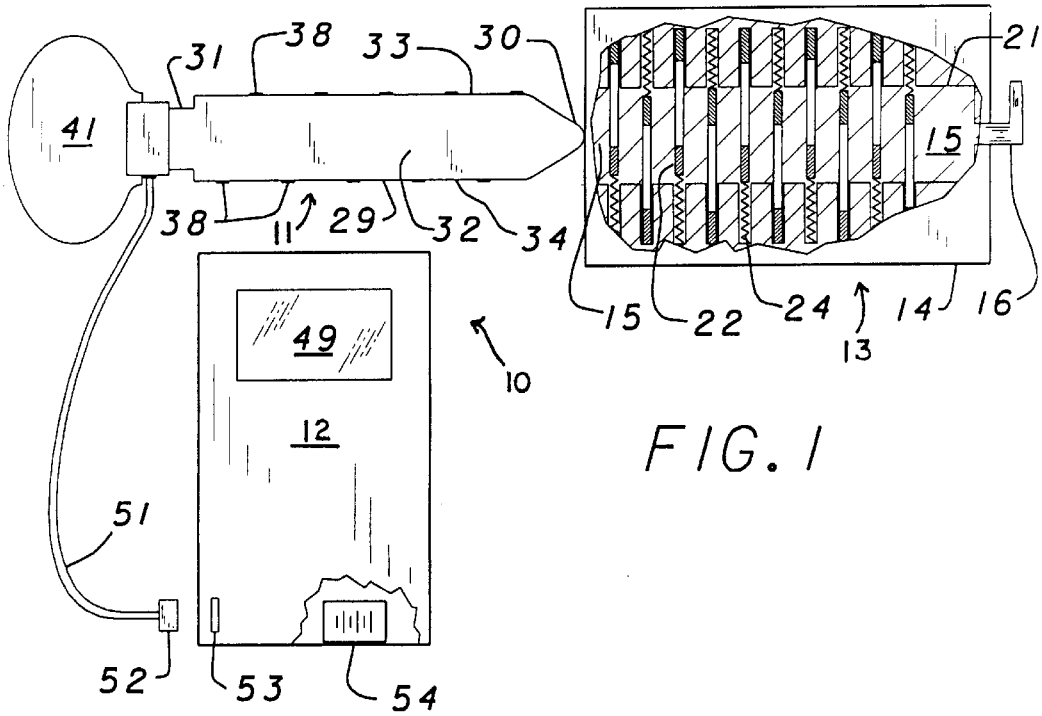
FIG. 1 is a schematic view of an embodiment of the lock decoding apparatus of the present invention in association with a wafer type of lock.
Figure 2:
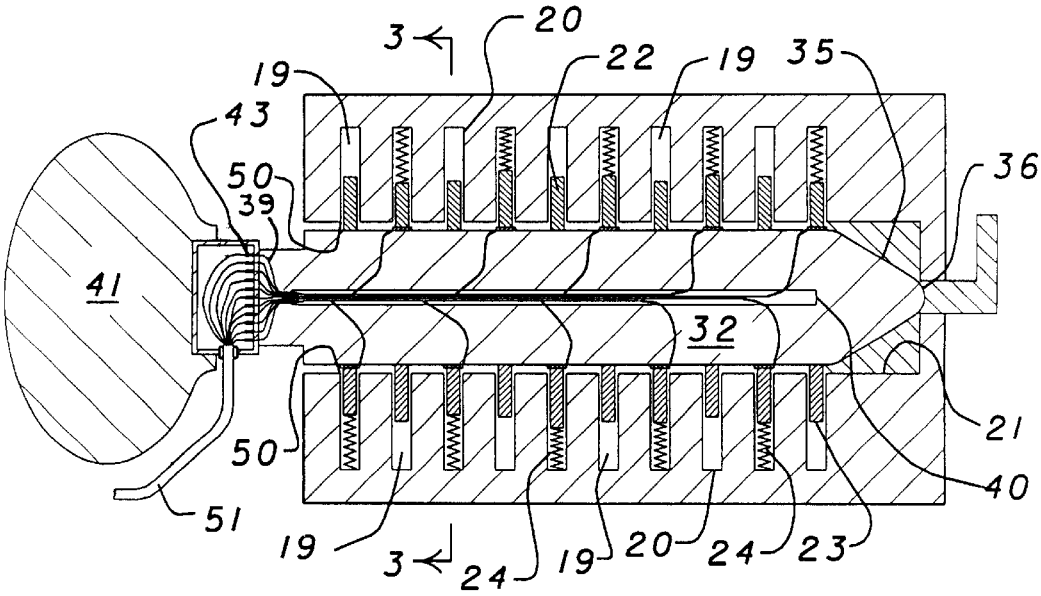
FIG. 2 is an enlarged fragmentary view of the embodiment of FIG. 1 shown interactively engaged with a wafer type lock.
Figure 3:
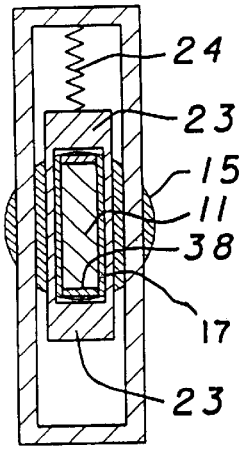
FIG. 3 is a sectional view taken in the direction of the arrows upon line 3—3 of FIG. 2.

Referring now to FIGS. 1–3, an embodiment of the lock decoding system 10 of the present invention is shown comprised of probe key device 11 interactive with wafer type lock 13, and electrically interconnected to electronic monitor and display unit 12.

Wafer type lock 13, of conventional construction, is comprised of a housing 14 having a bore 21 which rotatably accommodates cylindrical plug 15 having terminal shackle means 16 extending beyond said housing and adapted to interact with electrical or mechanical features sought to be secured by the function of the lock. Plug 15 contains an elongated keyway slot 17 configured to receive probe key 11.

Figure 4:
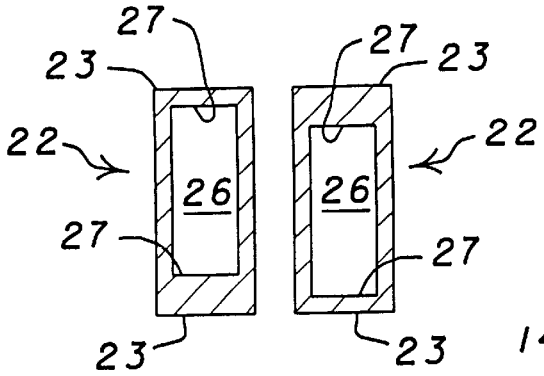
FIG. 4 PRIOR ART
FIG. 4 illustrates a standard prior art feature of wafer locks.

A series of chamber 19, which may range in number between about 5 and 10 are aligned in a uniformly spaced array in orthogonal relationship to bore 21. In the case of the exemplified wafer type lock, each chamber has opposed closed distal extremities 20 located within housing 14 on both sides of bore 21, and facing interior extremities 50 which open onto bore 21. A flat wafer 22 of elongated rectangular shape having opposed short sides 23 is slideably secured within each chamber. A coil spring 24 is located in each chamber in interactive abutment between a closed distal extremity 20 and one short side 23 of the wafer. As best shown in FIG. 4, each wafer 22 is of frame-like configuration having an interior aperture 26 of rectangular shape, with opposing edge surfaces 27 associated with said short ends 23. The length of each aperture, namely the distance between edge surfaces 27, is the same, and is essentially equal to the diameter of bore 21.

It is to be noted that apertures 26 are not centered within the wafer 22. The distance of displacement of the edge surface 27 with respect to the associated short sides 23 represents the travel distance for each wafer. In operation, when a proper key is inserted into keyway slot 17, as shown in FIG. 2, the key pushes against edge surface 27 of each wafer, compressing the spring and thereby slideably displacing the wafer by its particular travel distance within its chamber. This sequentially causes the apertures of all the wafers to align with the interior wall of bore 21. When such alignment is achieved, the key can then rotate plug 15 to open the lock.

The coil springs 24 are of identical construction and exhibit identical Hooke's law characteristics, as may be expressed by the equation: W=KY, where W is the applied force, Y is the distance of deformation, and K is a constant for the particular spring. In the locks serviceable by the apparatus of this invention, it is important that the force W generated by very slight compaction in the order of 1–3 millimeters is significantly greater than the weight of the wafer, or tumbler pins in the case of tumbler locks.

Key device 11 has the general size and contour of a key expected to fit within the keyway slot 17 of the type of lock sought to be decoded. Key device 11 is comprised in part of a straight shank 29 elongated between forward and rearward extremities 30 and 31, respectively. Shank 29 is bounded by opposed flat side surfaces 32 and straight parallel upper and lower edge surfaces 33 and 34, respectively. A tip portion 35 of said shank is defined in part by straight oblique ramp surface 36 extending forwardly and downwardly from upper edge surface 33.

The length of shank 29, measured between said forward and rearward extremities, may be between about 25 and 50 millimeters. Its width, measured between said upper and lower edge surfaces, may be between about 5 and 10 millimeters, and its thickness, measured between flat side surfaces 32, may be between 1 and 2 millimeters.

Force sensors 38 are adhered to upper edge surface 33, and in some embodiments, also adhered to lower edge surface 34. The spacing of the sensors is such as to position a sensor beneath each chamber 19. The sensors measure the force exerted by the action of spring 24 in each chamber. Those chambers wherein the spring is most compressed will cause the resident wafer to exert greater force on the associated sensor than chambers wherein the spring is less compressed by virtue of a smaller travel distance of the wafer.

Suitable force sensors for use on probe key 11 device may be strain gauge devices. Suitable strain gauges are made by SMD Company of Meridian, Conn., and are fabricated as sputtered thin film strain gauge devices having a thickness of about 0.20 inch. Such thin strain gauges are capable of measuring forces up to 12 pounds at a deflection of 0.015 inch, producing up to a 2.0 millivolt output based upon a 10 volt excitation current. The specific actual voltage output is directly related to the amount of force directed upon the gauge. The strain gauges are adhered to said edge surfaces preferably by way of a very thin film of a high modulus adhesive such as cyanoacrylate, or cross-linked epoxy.

Electrical conductor means in the form of printed circuit or wires 39 are attached to sensors 38, and extend along the length of shank 29, preferably disposed within groove 40. A head portion 41, attached to the rearward extremity of said shank, facilitates the manipulation of the probe key. Said head portion contains electrical terminals 43 connecting to each electrical conductor wire.

Figure 6:
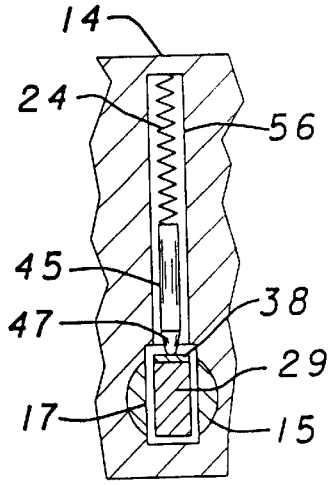
FIG. 6 is a sectional view taken in the direction of the arrows upon the line 6—6 of FIG. 5.
Figure 5:
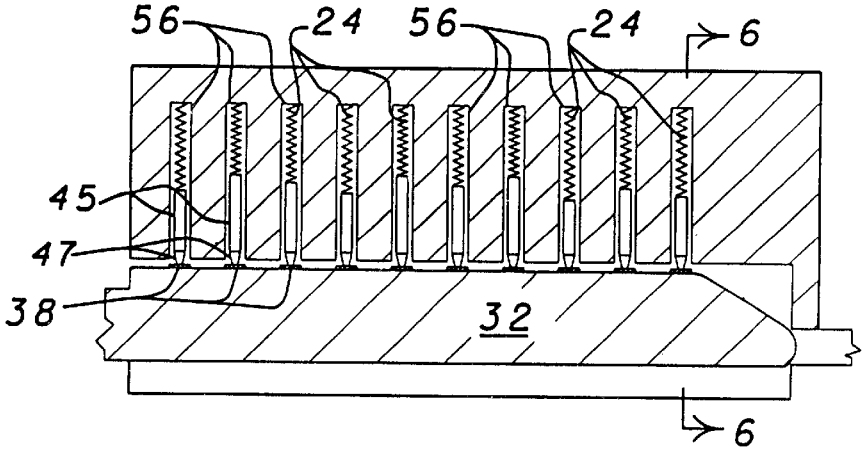
FIG. 5 is an enlarged fragmentary vertical sectional view of another embodiment of the apparatus of this invention shown interactively engaged with a tumbler type lock.

In the case of tumbler type locks, as illustrated in FIGS. 5 and 6, the multiple spring-confining chambers characteristic of the above-described wafer locks, are now cylindrical chambers 56 that contain tumbler pins 45 instead of wafers.

The pins, which are urged by springs 24 toward bore 21, have varied lengths. The variation in said lengths represents the travel distance for each tumbler in order to establish a shear line which will permit rotation of plug 15. The downwardly directed tip 47 of each tumbler pin is positioned to bear down upon an associated force sensor 38. The variation in the lengths of the tumbler pins produces varied degrees of compression of their respective springs, with resultant variation in the amount of downward force applied by the pin upon its associated force sensor.

Said electronic monitor and display means 12 is interactive with electrical conductors 39 by way of terminals 43, connector cable 51, plug 52 and socket 53. Said display means indicates the force reading on each individual sensor. Said reading corresponds to the requisite travel distance for a particular slideable member at a particular axial location, and dictates the key cut required at a particular tumbler or wafer to establish an open shear line to open the lock. The appropriate information to permit the cutting of a key may be shown in digital format in window 49. A DC battery 54 associated with said electronic monitor and display means 12 supplies a voltage to said sensors, thereby creating an electrical circuit that passes through each sensor. The output from each sensor is monitored by a Wheatstone bridge circuit in said monitoring means 12, and is converted into the read out that appears in window 49.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. Apparatus for decoding a lock having a rotatably mounted cylindrical plug having an elongated key receiving slot interactive with a series of slideable members urged by identical coil springs orthogonally toward said slot and having different travel distances relative to flush fit with the cylindrical surface of said plug, said flush fit establishing a shear line which permits rotation of the plug, said springs undergoing linear compression by said key by an amount equal to said travel distance, and producing a resistive force proportionate to said travel distance, said apparatus comprising:

a) a probe device having the general contour of a key expected to fit within said key receiving slot and having:

1) a straight shank elongated between forward and rearward extremities and bounded by opposed side surfaces and upper and lower edge surfaces, and terminating in a tip portion having an oblique ramp surface extending forwardly and downwardly from said upper edge surface, 2) a series of spaced apart force sensors associated with said upper edge surface, said sensors being capable of changing their electrical resistance in response to force applied thereto, 3) a head portion associated with the rearward extremity of said shank to facilitate manipulation of the probe device, and equipped with electrical terminals, and 4) electrical conductor means extending from each sensor to said electrical terminals, b) electronic monitoring and display means interactive with said sensors by way of said terminals and serving to indicate the combined force attributed to the effect of said spring and the weight of said slideable members for each slideable member of said series, and c) a source of low voltage direct current adapted to flow through said sensors and electronic monitoring and display means.

2. The apparatus of claim 1 wherein said lock is a wafer lock.

3. The apparatus of claim 1 wherein said lock is a tumbler lock.

4. The apparatus of claim 1 wherein said force sensors are adhered to the upper edge surface of said shank.

5. The apparatus of claim 1 wherein the slideable members of said lock number between 5 and 10 and are disposed in separate chambers in a uniformly spaced array.

6. The apparatus of claim 1 wherein the force generated by compaction of said springs by 1 to 3 millimeters is significantly greater than the weight of the associated slideable member.

7. The apparatus of claim 1 wherein the length of said shank, measured between said forward and rearward extremities is between 25 and 50 millimeters, its width, measured between said upper and lower edge surfaces, is between 5 and 10 millimeters, and its thickness, measured between said opposed side surfaces is between 1 and 2 millimeters.

8. The apparatus of claim 1 wherein said force sensor is a strain gauge.

9. The apparatus of claim 8 wherein said strain gauge is of sputtered thin film construction.

10. The apparatus of claim 9 wherein said strain gauge is capable of measuring forces up to 12 pounds at a deflection of 0.015 inch, producing up to a 2.0 millivolt output based upon a 10 volt excitation current.

11. The apparatus of claim 5 wherein the spacing of said sensors on said shank is consistent with the spacing of the chambers holding said slideable members.

* * * * *